US006737388B2

(12) United States Patent
Shepherd

(10) Patent No.: US 6,737,388 B2
(45) Date of Patent: May 18, 2004

(54) LUBRICANT FOR AMMUNITION AND METHOD OF USE THEREFOR

(76) Inventor: Douglas Shepherd, 410 Dockside Cove, Woodstock, GA (US) 30189

( * ) Notice: Subject to any disclaimer, the term of this patent is extended or adjusted under 35 U.S.C. 154(b) by 0 days.

(21) Appl. No.: 10/154,139

(22) Filed: May 23, 2002

(65) Prior Publication Data

US 2002/0177531 A1 Nov. 28, 2002

Related U.S. Application Data

(60) Provisional application No. 60/293,098, filed on May 23, 2001.

(51) Int. Cl.[7] ..... C10M 141/04; F42B 14/00

(52) U.S. Cl. ..... 508/168; 508/181; 508/577; 508/583; 86/19; 102/511

(58) Field of Search ..... 508/167, 168

(56) References Cited

U.S. PATENT DOCUMENTS 4,333,840 A * 6/1982 Reick ..... 508/181
4,731,189 A * 3/1988 Gregg, Jr. ..... 508/120
5,059,334 A * 10/1991 Scheld ..... 508/181
5,062,974 A * 11/1991 Van Meter ..... 508/167
5,518,639 A * 5/1996 Luk et al. ..... 508/167
5,910,345 A * 6/1999 Luban ..... 427/600
5,970,877 A * 10/1999 Hensler ..... 102/288
6,090,756 A * 7/2000 Brown ..... 508/118
6,576,598 B2 * 6/2003 Brown ..... 508/118

* cited by examiner

*Primary Examiner*—Ellen M. McAvoy
(74) *Attorney, Agent, or Firm*—Arnold S. Weintraub; C. Dennis Lacina; The Weintraub Group, P.L.C.

(57) ABSTRACT

A lubricant composition for ammunition is an admixture of (a) molybdenum disulfide, (b) a fluorotelomer lubricant, and (c) a solvent medium which is deposited onto (d) a corn cob particle absorbent. Metal particles such as BBs or other grit may be included in the composition for use with copper jacketed bullets. The lubricant composition is deposited on the bullets by tumbling or vibrating the bullets, or otherwise contacting the bullets with the lubricant composition; drying the bullets and, thereafter contacting the bullets with untreated corn cob particle.

14 Claims, No Drawings

LUBRICANT FOR AMMUNITION AND METHOD OF USE THEREFOR

CROSS-REFERENCE TO RELATED APPLICATIONS

This application is a completion application of U.S. Provisional Patent Application Serial No. 60/293,098, filed May 23, 2001, for "Lubricant for Ammunition and Method of Use Therefor", the disclosure of which is hereby incorporated by reference.

BACKGROUND OF THE INVENTION

The present invention pertains to lubricants for ammunition. More particularly, the present invention pertains to lubricants for jacketed ammunition. Even more particularly the present invention pertains to molybdenum disulfide-based lubricants and methods of use therefor with jacketed ammunition.

PRIOR ART

The use of a lubricant for ammunition is known for enhancing the life of the bore of a rifle. The lubricant also enables and assists in imparting less distortion and deformation of the bullets as they pass through the barrel thereby providing greater accuracy and higher muzzle velocities.

As is known to those skilled in the art to which the present invention pertains the use of molybdenum disulfide or "moly" as a lubricant for use with jacketed ammunition has long been known. Molybdenum disulfide is a mineral which has excellent lubricating qualities because of its crystalline structure which, enables the crystals to slide over each other easily. Molybdenum disulfide is used as an ammunition lubricant because it is stable both physically and chemically and does not break down in high temperatures such as are encountered within the barrel of a rifle or similar fire arm. It bonds to metals and does not migrate.

As noted, heretofore, molybdenum disulfide has been used as a lubricant for ammunition, but has been deposited on the ammunition in a dry state through a gentle tumbling process. This enables the molybdenum disulfide to form a bond to the jacket metal that keeps it in place until needed. The use of the dry lubricant eliminates the need for grease or bonding agents that could be detrimental to the bore of the rifle. However, because the lubricant is "dry", it is much more difficult to handle then if used in liquid state thereof.

It is to be readily appreciated that there are significant advantages if the "moly" could be applied in a wet state such as in a dispersion or solution because of the ease of handling.

As is detailed hereinafter, the present invention provides a molybdenum disulfide-based lubricant for jacketed ammunition which achieves the purposes hereof.

SUMMARY OF THE INVENTION

In accordance herewith there is provided a lubricant for coating ammunition which, generally, comprises: a) molybdenum disulfide, b) a polymeric lubricant, and c) a solvent, which is deposited onto d) an absorbent A predetermined amount of metal particles, depending on the type of ammunition may be introduced in the lubricant formulation.

The lubricant is applied by a method which generally comprises: contacting the ammunition with the absorbent which has the "wet" "moly" and the polymer deposited thereon. Thereafter the ammunition is dried to eliminate and remove residual solvent. Subsequent thereto, the so-treated ammunition is tumbled or vibrated with a plain or untreated absorbent.

By controlling the rate of evaporation of the solvent excellent adhesion is achieved For a more complete understanding of the present invention reference is made to the following detailed description.

DESCRIPTION OF THE PREFERRED EMBODIMENT

At the outset, and in the ensuing description, it is to be noted that the present invention is described with reference to copper jacketed ammunition, but, the present invention is of equal efficacy in connection with lead bullets.

As hereinabove noted, the present invention in a first aspect is directed to a lubricant for jacketed ammunition which, generally, comprises: a) molybdenum disulfide, b) a polymeric lubricant, and c) a solvent which composition is deposited onto d) a moisture absorbent. A predetermined amount of metal particles, depending on the type of ammunition may be introduced in the lubricant formulation.

Molybdenum disulfide is a dry powder available from many commercial sources. Typically, the molybdenum disulfide is ground to a powder of standard mesh screen or micron size. Such ground "moly" is well known and commercially available from a wide variety of sources. Any of such commercial forms may be used herein.

The polymeric lubricant contemplated for use is a fluorotelomer such as a polytetrafluoroethylene terpolymer. Polytetrafluoroethylene terpolymers are well known and commercially available such as those sold under the trademarks Krytox DF, Krytox 1000 and Krytox 2000 by DuPont Chemical as well as the Dupont Dry Film DE lubricant. These Krytox and Dry Film compounds are described as white, waxy particles which are sold commercially as dispersions in a solvent or as an aqueous solution thereof. Typical solvents in which the polymer is dispersed include, for example, isopropyl alcohol, HCFC Vertrel®xF or the like, as well as mixtures thereof. Generally, the dispersion will contain about 10% to 20% and usually about 20%, by weight of the telomer, be it in a solvent or as an aqueous solution.

The "moly" and the telomer are deposited onto an absorbent material by first dispersing the "moly" and the polymer in a suitable solvent mixture or medium. It has been found in the practice of the present invention that the most efficacious absorbent, which also functions as a polishing applicator, is ground corn cob. Corn cob is, as a ground product, well known and commercially available. Corn cob readily adsorbs the "moly" to enable easy transfer while providing a protective cushion for the copper jacket against continuous copper to copper contact during vibration or tumbling.

As noted, ground corn cob is well known and commercially available and is available as either coarse or medium grades having a 9 to 10 millimeter particle size.

In use the "moly", lubricant and corn cob are dispersed in the solvent medium. The solvent medium, generally, comprises, a mixture of an alkane and at least one alcohol. A ketone may, also, be incorporated into the solvent mixture.

Generally, the solvent medium will comprise from about 25%, by weight, to about 90%, by weight, based on the total weight of the lubricant composition or mixture.

Representative of the useful alkane solvents are hexane, heptane and the like, as well as mixtures thereof. Preferably, the alkane is heptane.

Useful alcohols include lower alkanols such as methanol, ethanol, propanol, isopropanol, butanol and the like as well as mixtures thereof. Preferably, a mixture of alcohols is employed. The preferred alkanol mixture comprises a mixture of methanol and isopropanol.

The ketone, where used, is, preferably, acetone.

Generally, the alkane is present in an amount ranging from about 15% to about 75%, by weight, based upon the total weight of the lubricant composition.

Generally, the alcohol will be present in an amount ranging from about 5% to about 15%, by weight, based upon the total weight of the lubricant composition.

Where a mixture of alcohol is used, the isopropanol is present in an amount ranging from about 1% to about 5% by weight and the methanol is present in an amount ranging from about 4% to about 10%, by weight.

Where used, the acetone is present in an amount ranging from about 5 to about 35%. If not present, then the amount of alkane is increased, such that it will comprise from about 20% to about 70%, by weight, of the composition.

In any event, the alcohol component will comprise from about 10% to about 45%, by weight, of the total composition weight.

The telomer, per se, is present in an amount ranging from about 0.25% to about 0.5% by weight, based upon the entire weight of the composition, exclusive of the dispersion medium.

The molybdenum disulfide powder is present in an amount ranging from about 1% to about 10% by weight, based upon the entire weight of the composition. Generally, "ultra fine" moly is used which has a micron size of a bout 1 to 3 microns.

The composition is prepared by mixing the together the "moly" together with the polymer in the solvent medium at ambient conditions to suspend the molybdenum disulfide and the telomer within the solvent medium.

In use, the use solution is admixed with the absorbent, namely, the corn cob to deposit the composition thereonto.

The metallic parts which are used in the tumbling process for both cleaning and deposition is a grit which is preferably, BBs, although, other grit can be used. Preferably, the BBs are either copper or zinc BBs.

It should be noted, however, that the use of the metallic particles is not critical hereto and need not be employed. Moreover, the use of metallic particles should be avoided with lead cast bullets.

The ammunition or bullets are tumbled or vibrated in a suitable closed or sealed container and brought into contact with the corn cob medium from which the molybdenum disulfide and polymer are deposited thereonto.

In using the composition hereof it is essential that the copper or lead cast bullets be free of oils and oxidation. Any standard well known commercially available copper cleaner may be used to clean the ammunition prior to applying the lubricant thereto.

Initially, after the bullets are cleaned, they are placed in a suitable container having the lubricant composition including the metal particles, disposed herewithin.

In treating the bullets it is preferable that they be at an elevated temperature ranging from about 100° F. to about 160° F., although ambient conditions are suitable so long as the temperature is not below 70°.

The bullets and composition are tumbled or vibrated within the container for a time period ranging from about 0.5 to about 2.0 hours and preferably, from about 0.5 to about 1.5 hours.

After completion of the vibratory process the residue may be sifted from the bullets and reused. After treatment the bullets are dried by exposure to air for a period of about one hour.

Thereafter, the bullets are placed in an additional quantity of untreated corn cob and tumbled therewith for about 30 seconds to about two minutes and thereafter separated by sifting from the corncob.

Furthermore, while reducing friction during barrel riffling, the present composition enables less pressure build-up in the bullet case for the same powder charge. It is therefore apparent that an additional charge increase can be attained while still maintaining manufacturer recommended operating conditions. This increase in powder charge results in a more uniform charge thereby increasing accuracy and bullet velocity.

While not preferred, it is possible to employ the mixture of "moly" and telomer as a "dry" lubricant by eliminating the solvent from the composition. Under such conditions, the amount of each ingredient is increased on a proportionate basis.

However, the full efficacy of the present invention is achieved with the solvent system. In this regard and as noted above, the adhesion is achieved by controlling the evaporation rate during the initial tumbling or vibration step in the sealed container.

The present invention eliminates the need for wax finishing or coatings while providing improved accuracy and elimination of pre-treating the barrel with molybdenum disulfide with minimal or negligible build up thereof in the barrel.

In practicing the present invention, and as noted above, the admixture of moly, polymer and solvent medium, after mixing with the absorbent is placed in a sealed container into which is placed the metal particles, if any. Then the ammunition is added thereto after which tumbling or vibrating is carried out. The temperature within the sealed container will control the rate of evaporation of the solvent and may be optimized by the operator. After the contact period, the balance of the process is carried out. The second tumbling or vibrating step need not be done under seal.

It should further be noted that trace amounts of an adhesion promoter, such as a polyurethane adhesive may be incorporated into the lubricant composition to enhance the adhesion of the lubricant composition to the exterior of the bullet.

It is to be appreciated from the preceding that the present invention provides both means and a method for "moly coating" rifle ammunition from a liquid or dry medium with minimal waste and re-usable components.

What is claimed is:

1. A lubricant composition for ammunition, comprising:

(a) a predetermined quantity of molybdenum disulfide, (b) a predetermined quantity of a fluorotelomer lubricant, (c) a solvent medium, the fluorotelomer being in admixture with the disulfide and the solvent medium to form a liquid lubricant, and (d) an absorbent, the liquid lubricant being deposited thereonto.

2. The composition of claim 1 wherein:

the solvent medium is present in an amount ranging from about 25% to about 90%, by weight, based on the total weight of the composition.

3. The composition of claim 1 wherein:

the solvent medium is a mixture of an alkane and an alcohol.

4. The composition of claim 3 wherein the solvent further includes a ketone.

5. The composition of claim 3 wherein:

the alkane is heptane and the alcohol is a mixture of methanol and isopropanol.

6. The composition of claim 2 wherein:

(a) the disulfide is present in an amount ranging from about 1% to about 10% by weight, based on the total weight of the composition; and (b) the telomer lubricant is present in an amount ranging from about 0.25% to about 5% by weight, based on the total weight.

7. The composition of claim 1 wherein the absorbent is corn cob particles boring a 9 to 10 mm particle size.

8. The composition of claim 1 which further includes a quantity of grit.

9. The composition of 8 wherein the grit is selected from the group consisting of copper BBs, zinc BBs and mixtures thereof.

10. A method of applying a lubricant to a bullet which comprises:

(a) contacting an oil free and oxidant free bullet with a lubricant composition in a sealed container for a period of about 0.5 to about 2.0 hours at a temperature of from about 70° F. to about 160° F.;

(b) separating residual lubricant composition from the bullet;

(c) drying the bullet; and (d) thereafter contacting the bullet with an absorbent for a period of from about 30 seconds to about 2 minutes, and (e) wherein the lubricant composition is the composition of claim 1.

11. The method of claim 10 wherein:

(a) the lubricant composition includes a quantity of grit; and (b) the bullet is a copper jacketed bullet.

12. The method of claim 10 wherein:

the absorbent is corn cob particles having a 5 to 10 millimeter particle size.

13. The method of claim 10 wherein:

the solvent is a mixture of an alkane and an alcohol.

14. The method of claim 12 wherein:

(a) the alkane is heptane, and (b) the alcohol is a mixture of methanol and isopropyl alcohol.

* * * * *